United States Patent [19]

Mangan

[11] Patent Number: 5,006,375

[45] Date of Patent: Apr. 9, 1991

[54] ORNAMENTAL ARTICLE

[76] Inventor: Louis H. Mangan, 734 N. Spring Valley Pkwy., Elko, Nev. 89801

[21] Appl. No.: 470,711

[22] Filed: Jan. 26, 1990

[51] Int. Cl.[5] ..... A47G 33/08

[52] U.S. Cl. ..... 428/13; 40/406; 63/12; 446/267

[58] Field of Search ..... 446/14, 267; 428/11, 428/13; 40/406; 63/12; 272/8 N

[56] References Cited

U.S. PATENT DOCUMENTS 2,741,693 4/1956 Fasson ..... 40/406
4,142,383 3/1979 Eberhart ..... 428/13 X
4,148,199 4/1979 Boykin ..... 63/12
4,196,899 4/1980 Patterson ..... 428/13 X

*Primary Examiner*—Henry F. Epstein
*Attorney, Agent, or Firm*—M. Reid Russell

[57] ABSTRACT

An ornamental object comprising a transparent housing shaped into a decorative configuration and having a liquid therein and a sub-atmospheric pressure area between the liquid and the housing whereby ambient air temperatures will cause the liquid to boil; and wherein particles and/or larger solid objects may be placed within the liquid to be agitated by the boiling action of the liquid.

4 Claims, 1 Drawing Sheet

ORNAMENTAL ARTICLE

BRIEF DESCRIPTION OF THE INVENTION

Background of the Invention

1. Field of the Invention

This invention relates to ornamental articles such as earrings, necklaces, and other products used for decorative purposes, such as Christmas tree ornaments, household decorations, and jewelry.

2. Prior Art

It has been recognized in the past that ornamental articles having transparent surfaces and interiors filled with liquids and with moving bubbles in liquids, have been used for different types of ornamental articles.

U.S. Pat. No. 4,148,199, for example, discloses a pierced earring comprising sections of transparent plastic material forming a housing for a selected colored liquid. U.S. Pat. No. 2,741,693, discloses a ornament having a transparent housing and that is at least partially filled with a liquid that is heated by an electric filament to cause boiling of the confined liquid for decorative and attention attracting effects.

The prior art devices, of which I have knowledge, either do not provide for liquid movement, and rely entirely upon the appearance of the liquid itself to provide a desired artistic effect, or they utilize some outside source, such as an electrical filament, as a means of causing movement of the liquid within a housing.

SUMMARY OF THE INVENTION

Objects of the Invention

It is a principal object of the present invention to provide a decorative article that utilizes a transparent housing to contain a liquid and that further utilizes a reduced pressure in the housing to cause a constant agitation and boiling action of the liquid in the housing.

It will be apparent that liquids of different colors can be utilized with the present invention and that any liquid capable of boiling under the reduced pressure vacuum applied within the housing, can be used.

Features of the Invention

Principal features of the invention include a housing shaped to provide a desired appearance, such as a heart, star, ring, Christmas tree, or the like, and sealed to fully encapsulate a liquid that is placed in the housing, under vacuum, prior to setting of the housing so that the liquid will constantly boil at normal room temperatures.

Additional objects and features of the invention will become apparent from the following detailed description, taken together with the accompanying drawings, showing preferred forms of the invention.

DETAILED DESCRIPTION

Figure 1:
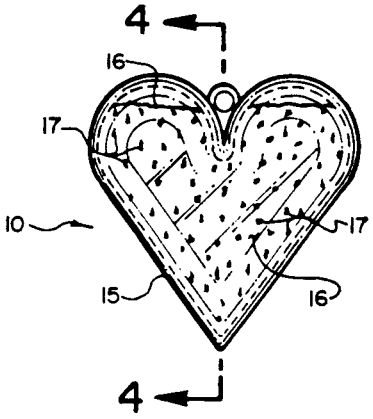
FIG. 1 is a front elevation view of a typical ornament shaped as a heart, of the invention.
Figure 3:
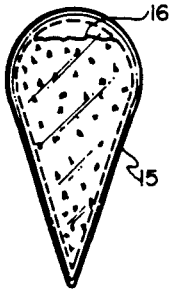
FIG. 3, an elevation view.
Figure 4:
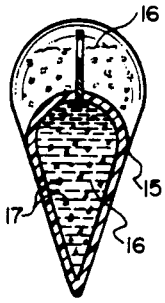
FIG. 4, a vertical section taken on the line 4—4 of FIG. 1.
Figure 2:
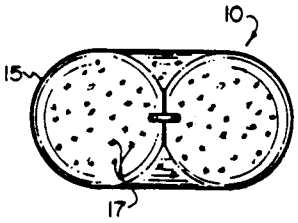
FIG. 2, a top plan view.
Figure 5:
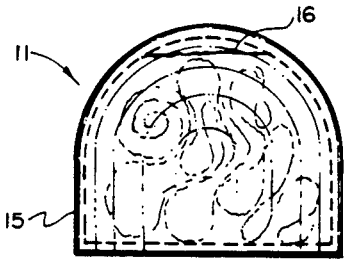
FIG. 5, a front elevation view of another embodiment of the invention, in a bell-shape.
Figure 7:
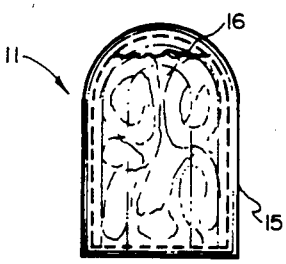
FIG. 7, an end elevation view.
Figure 6:
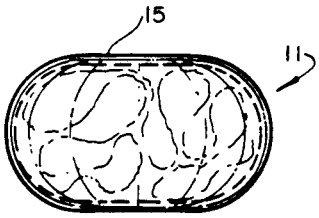
FIG. 6, a top plan view.
Figure 8:
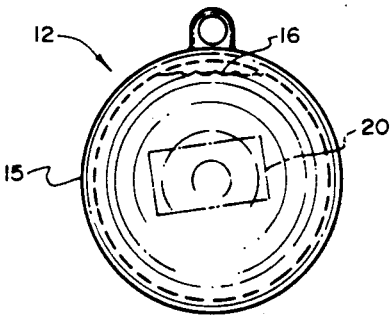
FIG. 8, a front elevation view of a spherically shaped ornament of the invention.
Figure 9:
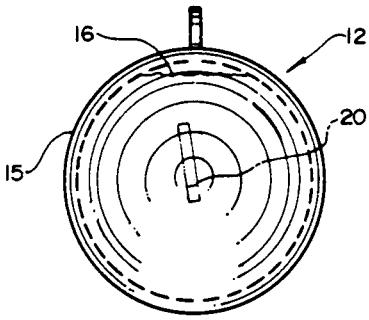
FIG. 9, a side elevation view.

Referring now to the drawings:

In the illustrated preferred embodiment, the ornamental device of the invention is shown in the shape of a heart in FIGS. 1–4, the shape of a bell in FIGS. 5–7, and a shape of a sphere, 12, in FIGS. 8 and 9.

In each embodiment of the invention shown, the invention includes a housing 15, that is totally sealed, and that is made of a transparent material, such as plastic. The housing 15 is totally sealed and provides a space therewithin for a liquid 16 which may have particles 17 dispersed throughout. A sub-atmospheric pressure is created in the space above the fluid and inside the housing 15, before the housing is sealed. Thus, the sub-atmospheric pressure is maintained within the housing 15 and the liquid, which may be colored water, or any other suitable liquid, is caused to boil by the outside room temperature. It has been found that so long as the ambient temperature is at 60° Farenheit, or above, the liquid when water is used, will boil. Particles 17 may also be provided in the housing, if desired. The boiling action causes the particles 17 to move within the liquid body and the liquid body itself to be agitated. The appearance, of the transparent body, with the boiling liquid and constantly moving particles is generally considered to be very attractive. It will be apparent that different types of particle materials can be used to move within the liquid 16. The particles may take the form of very small rectangular, round, ball-like materials, as shown in FIGS. 1–5, or they may be thin, flat objects such as are shown in FIGS. 5–7, and a sphere configuration in FIGS. 8 and 9, it will be obvious that a great many other configurations such as stars, candles and the like and of varying sizes, can be used.

In FIGS. 8 and 9, there is shown a spherical housing 15 with the liquid 16 therein. A solid object here shown as a name plate 20, to be engraved with a desired name, and/or address, may be placed within the housing 15 and moves within the housing upon agitation of the liquid 16 as a result of the boiling action that occurs in the housing 15.

Although a preferred form of my invention has been herein disclosed, it is to be understood that the present disclosure is by way of example and that variations are possible without departing from the subject matter coming within the scope of the following claims, which subject matter I regard as my invention.

I claim:

1. An ornamental object comprising a housing of transparent material and totally sealed to provide a space therewithin; a liquid in the housing; particle material in the liquid individual particles of which having a greater specific gravity than that of said liquid; and a sub-atmospheric pressure formed in the space between the liquid and the housing whereby ambient temperatures will cause the liquid to boil within the housing, bubbles created in that boiling to attach to said individual particles elevating them within said liquid.

2. An ornamental object as in claim 1, wherein the housing is shaped to form a decorative article.

3. An ornamental object as in claim 1, further including a solid object in the housing that has a greater specific gravity than that of said liquid.

4. An ornamental object as in claim 3, wherein the solid object comprises a name plate viewable through the wall of the housing.

* * * * *